United States Patent [19]

Fogg

[11] 4,269,236

[45] May 26, 1981

[54] CONTAINER FILLING DEVICE

[75] Inventor: Michael T. Fogg, Holland, Mich.

[73] Assignee: Fogg Filler Company, Holland, Mich.

[21] Appl. No.: 40,068

[22] Filed: May 17, 1979

[51] Int. Cl.[3] ..... B67C 3/26

[52] U.S. Cl. ..... 141/293; 141/392

[58] Field of Search ..... 141/1–11, 141/37–66, 285–310, 392

[56] References Cited

U.S. PATENT DOCUMENTS

| | | | |
|---|---|---|---|
| 3,450,175 | 6/1969 | Norwood | 141/392 |
| 3,729,030 | 3/1973 | Brissenden | 141/392 |
| 3,913,639 | 10/1975 | Davis | 141/392 |
| 4,094,343 | 6/1978 | Koreska | 141/392 |

*Primary Examiner*—Houston S. Bell, Jr.

*Attorney, Agent, or Firm*—Gordon W. Hueschen

[57] ABSTRACT

The invention disclosed is an integral attachment for a container filling device which comprises a filling head having a tubular closure adapted to be opened when the filling head is inserted into the container to be filled, and an annular member functioning as a container closure member and having a central opening slightly larger than the tubular closure, an upper annular member spaced from the first annular member and integrally connected thereto by a resilient tubular member, the upper annular member having a close fit with the tubular closure in order to hold the attachment in place when it is slid onto the tubular closure, at least one vent aperture extending through the lower annular member with its vent end opening in the upper surface thereof in a position where it is adapted to be closed by the upper annular member when the resilient tubular member is collapsed by pushing the lower annular member upward into contact with the upper annular member, and the annular members having an island of surface-to-surface contact surrounding each vent end opening. These islands are comprised of raised portions having an upper surface which seals against a complementary surface of the upper annular member. Additional raised portions cooperate with the first raised portions to form pressure points and the lower annular member has an annular inlay extending outwardly from under these pressure points.

19 Claims, 7 Drawing Figures

CONTAINER FILLING DEVICE

FIELD OF INVENTION AND PRIOR ART

This invention relates to a container filling device and is particularly directed to a new and improved container filling device useful for filling all kinds of rigid containers and is especially useful in filling rigid or semi-rigid wide-mouthed containers.

It is common practice in this art to fill containers by gravity feed from a reservoir through a filling head. The filling head has a tube for conducting liquid from the reservoir into the container and a vent tube for venting gases from the container to the ambient atmosphere. It also has a closure which closes off both tubes, which closure is spring-actuated to closed position. Ordinarily, the container is moved upwardly to engagement with a container-closure member which seals off the mouth of the container. Then, on further upward movement of the container, the spring means is depressed and the vent and liquid discharge tubes are uncovered. Liquid then flows into the container until it reaches the level of the filling tube. Thus, the extent to which the vent tube is inserted into the container determines the level of liquid therein.

Container filling devices of the character to which the invention relates are disclosed in the following U.S. Pat. Nos.:

1,371,244, Huntley
2,082,907, Thompson
2,628,759, Bodendoerfer
2,630,960, Lippold
2,893,445, Geitner
3,155,125, Mojonnier
3,209,794, Granier
3,416,577, Franz
3,586,066, Brown
3,756,290, Cleland
3,871,425, Fee
3,848,645, Franz It sometimes happens that, when the container is filled, difficulty is encountered in the break away of the container from the container closure member due to there having been formed in the container a partial vacuum. This may be brought about by the kind of filling liquid. Thus, if a hot liquid is employed, cooling of the liquid or the air space will set up a substantial vacuum. Also, it sometimes happens that when a soft sealing surface exists between the container closure member and the mouth of the container and the container is filled close to the top of the mouth of the container, the extent to which the mouth of the container imbeds in the container closure member may help establish a vacuum.

It has been proposed heretofore to avoid this problem of a vacuum by providing a secondary vent which vents the head space to the ambient atmosphere when the primary vent is closed. It is necessary of course that the secondary vent be closed when the primary vent is opened, at least in the late stages of the filling operation; otherwise the filling would not automatically stop. Thus, in U.S. Pat. No. 1,371,244 and U.S. Pat. No. 2,893,445, means is provided for closing the secondary vent before the primary vent is opened. In the first patent, a floating washer is spaced from the container closing member by ribs therein which, as the container is pushed up into the filling device or vice versa, causes a compression of the ribs so that the vent is effectively closed. In the second patent, a vent or vents pass up through the container closure member and are closed when the container closure member is distorted by the pressure of the mouth of the container thereon.

Neither of these prior art devices is entirely satisfactory, because the sealing force required to seal the secondary vents is sometimes equal to or greater than the force needed to break the vacuum and, in all vents, excessively high. The prior art devices, therefore, are not well suited for handling wide-mouthed containers, because the pressure, necessary to collapse the rib portion of the container closure member in one case and the container closure member itself in the other, is greater than can be generated by the same filling machine and greater than some containers can sustain.

OBJECTS OF THE INVENTION

It is an object of the invention to provide a new and improved container filling device. It is a further object of the invention to provide a new and improved container filling device which avoids the disadvantages of the prior art. It is a further object of the invention to provide a container filling device having secondary vent means adapted to be opened by relatively little pressure. It is a further object of the invention to provide a container filling device which is adapted to the filling of wide-mouthed containers. Further objects and advantages of the invention will appear as the description proceeds.

BRIEF DESCRIPTION OF THE INVENTION

The invention relates to improvements in container filling devices of the class described, that is to say, container filling devices having a container closure member, a filling head projecting downwardly axially through the closure member and having a liquid discharge means for discharging liquid into the container and primary vent means for venting gas from the head space of the container as it is being filled; a first closure means for closing the filling head and simultaneously closing both the liquid discharge means and the primary vent means; first resilient means for urging the first closure means to closed position; first coupling means between the first closure means and the container closing member operative on upward movement of the latter to compress the first resilient means and to open the first closure means; secondary vent means for venting the head space in said container when the first closure means is in closed position; second vent closing means for closing the secondary vent means; second resilient means for urging the second vent closing means to open position; second coupling means for coupling the container closure member and the second vent closing means operative on movement of the container closure member upward to compress the second resilient means and to close the secondary vent means; and the container closure member being an annulus having a sealing surface on its undersurface; which is adapted to engage the mouth of the container during the filling operation, so that the only access to the interior of the container is through the liquid discharge means and the vent means.

In particular, the invention relates to improvements in which the secondary vent means comprises at least one aperture having its vent end opening in the portion of the upper surface of the annular container closure member which is exposed to the ambient atmosphere and lies between the central opening thereof and the periphery thereof, and having its inner end opening in a surface of the annular container closure member which is exposed to the atmosphere confined in the head space of the container; in which the second vent closure means comprises a second annular member surrounding the filling head and spaced above the first annular member and held away therefrom by the second resilient means, except when the latter is compressed; and in which said annular members have an island of surface-to-surface contact surrounding each vent end opening.

Advantageously, the first resilient means requires more force to compress it than is required to compress the second resilient means whereby, on upward movement of the closure member, the secondary vent means is closed before the first closure means opens, and in the reverse direction, the first closure means is closed before the secondary vent means is opened.

Another aspect of the invention comprises an integral attachment for a container filling device having a tubular filling head with a slideable sleeve closure adapted to open when the filling head is inserted into the container to be filled, characterized by an annulus functioning as a container closure member, which annulus has an opening slightly larger than the diameter of the sleeve, an upper annulus spaced from the first annulus and integrally connected thereto by a resilient tubular member, which upper annulus has a close fit with the slideable sleeve closure in order to hold the attachment in place when it is slid onto the tubular filling means, at least one vent aperture extending to the lower annulus with its vent end opening in the upper surface thereof in a position where it is adapted to be closed by the upper annulus when the resilient tubular member is collapsed by pushing the lower annulus upwardly into contact with the upper annulus.

More particularly, the invention relates to improvements in a container filling device of the class described in which the area of surface-to-surface contact between the two annular members is not greater than about ½ square inch and the total pressure engendered by the second resilient means when it is compressed is greater than this area times atmospheric pressure (14.7 pounds per square inch), but not substantially greater than about 7.5 pounds.

One of the problems to which the invention is directed arises from the fact that, under some conditions of operation, inordinately high negative pressures obtain in the head space at the face of the filling operation. Theoretically, the potential vacuum or negative pressure that would prevent the container from freely breaking away from contact with the container closure member could be equal to the number of square inches of the top surface of the container mouth times 14.7 pounds per square inch of atmospheric pressure. On a wide-mouth container, for example, which has a mouth opening of three inches diameter, the area which is equal to $\pi r^2$, would be slightly over 7 square inches. Multiplying this by 14.7, there is obtained a potential vacuum lock of about 103 pounds. Because this amount of pressure is impractically high, various means have been proposed heretofore for breaking this vacuum. The means heretofore available, however, while satisfactory for strong containers such as metal containers and glass containers, have not been satisfactory for wide-mouthed containers, especially thin-walled, fragile containers made of light plastic or paper.

In accordance with the invention, it has been found that by locating the vent end of the vent apertures of the secondary vent means in the portion of the container closure member, which is exposed to the ambient atmosphere and lies between the central opening and the periphery of the container closure member, and by keeping the total area of surface-to-surface contact around the vent ends thus exposed to the ambient atmosphere small, advantageously, to less than about ½ square inch, the pressure necessary to break the vacuum in the head space can be kept low, advantageously, below about 7½ pounds. Thus, the pressure needed to compress the resilient means, when the container is pushed upwardly against the container closure member, can be kept low enough, say, below about 10 or 15 pounds, so that thin-walled paper or plastic containers can be utilized in the filling device with minimum upward lift pressure.

It has been found that this aspect of the invention can most most effectively be realized by providing in the upper surface of the container closure member a plurality of raised portions, in at least one of which a vent end opening of a vent aperture opens in a position to be sealed off when the raised portions are pushed up into surface-to-surface contact with the complementary portions of the upper annulus. In order to keep the area of surface-to-surface contact to a minimum, it is desirable that not more than two such raised portions be provided with vent apertures. Additional such raised portions, however, may be provided without vent apertures therein for the purpose of symmetry and for the purpose of providing a plurality of base pressure points adapted to press on the container closure member and hold it in sealing contact with the mouth of the container when it is pushed up into contact with the upper annulus.

Advantageously, to accommodate a wide range of bottle or can neck sizes, the vent aperatures are angled down, from a point in the upper surface of the container closure member intermediate between the central aperture and the periphery thereof in the portion of the container closure member exposed to the ambient atmosphere, to the space between the central aperture of the container closure member and the filling tube.

In accordance with another aspect of the invention, an integral attachment for a container filling device is provided, embodying various features mentioned above. This integral attachment is molded from an elastomeric material as a single unitary piece. The upper annulus has an aperture which fits snugly on the slideable closure of the filling tube and is connected to the container closure member proper by a tubular portion, which acts as the second resilient means which functions to keep the secondary vent means open until the container closure member is pushed upwardly into contact with the upper annular member. Advantageously, an annular inlay of rigid material, for example, stainless steel, can be imbedded in the container closure member extending outwardly from beneath the raised portions (pressure points) so that the pressure of the mouth of the container on the container closure member is transmitted directly to the raised portions so that they are brought into sealing contact with the upper annular portion.

Advantageously, the tubular member connecting the upper annulus with the lower annulus folds outwardly to facilitate collapse. Also, the walls are made thin enough and so correlated with the area of surface-to-surface contact around the vent end openings of the vent apertures whereby the attachment can be collapsed without excessive strain on thin-walled containers, or excessive lift requirements, so that the vacuum in the head space can be easily broken.

DETAILED DESCRIPTION OF THE INVENTION

Figure 2:
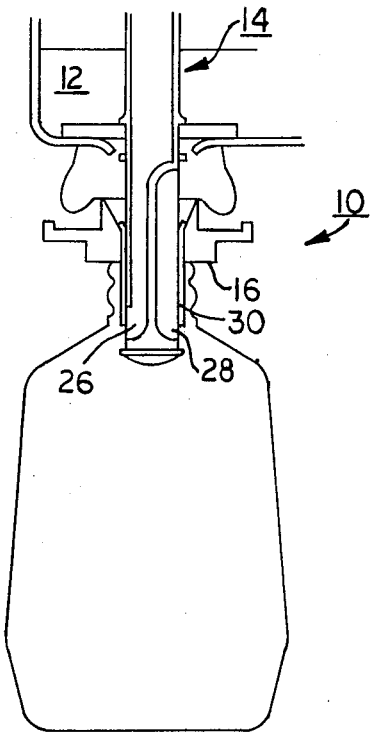
FIG. 2 is a like view with the filling head open.
Figure 1:
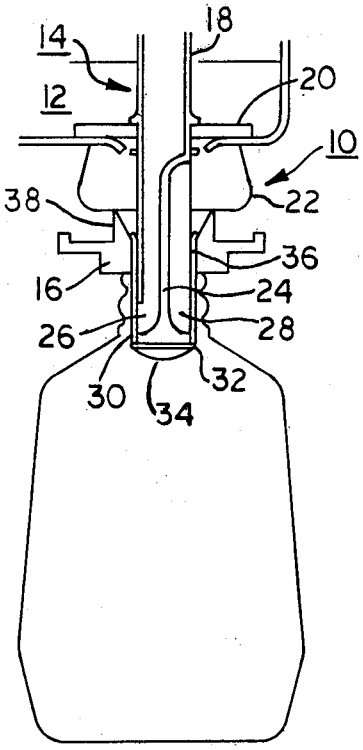
FIG. 1 is an outline view of a cross-section of a container filling device of the prior art with the filling head closed.

In FIGS. 1 and 2 there is disclosed a container filling device comprising a reservoir 12, a filling head 14, and a container closure member 16.

The filling head 14 comprises an inner tubular member 18 which is fastened in the reservoir 12 by retaining ring 20. The inner tube 18 of the filling head projects downwardly through a cup-shaped diaphragm 22 of resilient material which communicates with reservoir 12. The tube 18 has a partition member 24 dividing it into a vent portion 26 and a liquid discharge portion 28 which passes down from the reservoir 12 into the diaphragm 22 which surrounds and communicates with the liquid discharge portion 28. The bottom of the discharge head 14 is provided with a sleeve closure 30 adapted to seat against an O ring 32 in the bottom 34 thereof. The sleeve 30 is adapted to slide upwardly and downwardly on the inner tube 18. The container closure member 16 is made of elastomeric material and has a central bore 36, fractionally or otherwise affixed to the sleeve 30 so that movement of the closure member 18, upwardly or downwardly, causes the sleeve 30 to move upwardly or downwardly.

Between the closure member 16 and the diaphragm 22 is a collar 38, the purpose of which is to cause collapse of the diaphragm 22 when the closure member 16 is pushed upward. If desired, the collar 38 can be formed integrally with the closure member 16 and the diaphragm 22 formed as a unitary molded unit. By proper choice of the length of the tube 18 and the length of the sleeve 30, the depth to which the sleeve 30 is inserted into the container can be adjusted to any particular situation. This determines the level to which the liquid will rise in the container.

The container closure member 16 is pushed onto the tube 18 against the collar 38 until the cup-shaped diaphragm 22 fits snugly against the bottom of the reservoir 12, in the position shown in FIG. 1. Now, when the container is moved upwardly against the container closure member 16, it pushes the container cover closure member 16 upwardly and causes the resilient diaphragm 22 to collapse to the position shown in FIG. 2. At the same time the sleeve 30 is raised, exposing the vent 26 and the liquid discharge portion 28.

Figure 3:
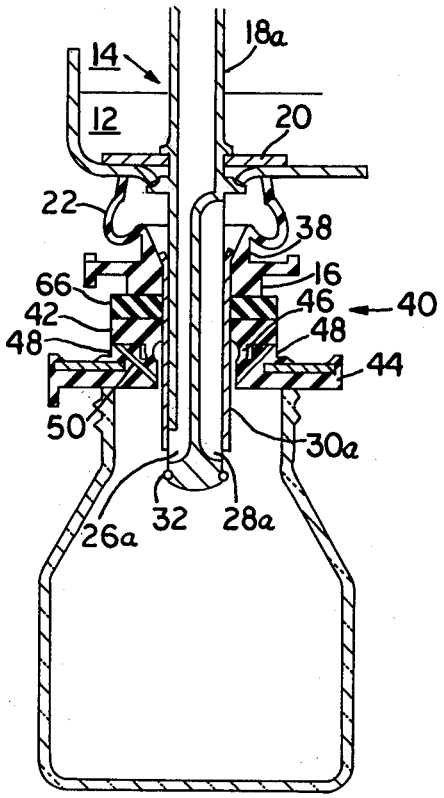
FIG. 3 is a like view of a container filling device modified in accordance with the invention.

Referring now particularly to FIG. 3, in which like parts are indicated by like numerals, there is shown an integral attachment for the filling device of FIGS. 1 and 2, which embodies the principles of the invention.

In this modification, the tube 18 is replaced by a longer tube **18*a* to accommodate the additional height of the filling head due to the attachment thereto. Similarly, the sleeve 30 is replaced by a longer sleeve 30*a***.

The attachment 40 has an annular top member 42 which frictionally engages sleeve **30*a* and moves as a unit with it up and down the inner tube 18*a*. In the lowermost position, the sleeve 30*a* rests against the O ring 32 and, for this purpose, the annular member 42 and the sleeve 30*a* need to be able to slide freely on the inner tube 18*a* so that, in the normal position, not shown, the sleeve 30*a* will be seated on the O ring 32 and close off the vent 26*a* and the liquid discharge 28*a***.

Figure 4:
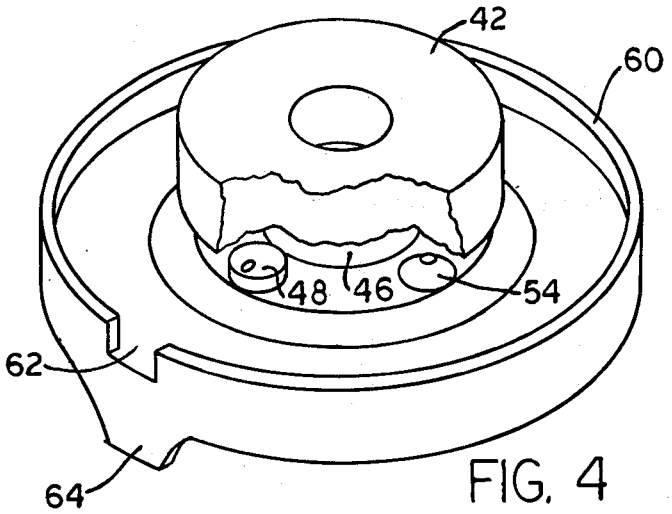
FIG. 4 is an isometric view with parts broken away of the integral attachment according to the invention.
Figure 5:
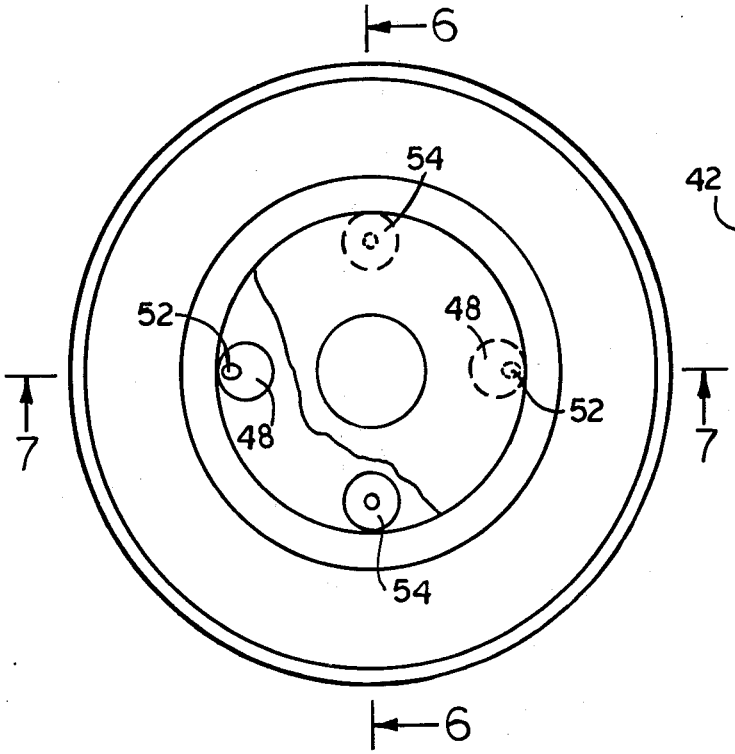
FIG. 5 is a plan view with parts broken away of FIG. 4.
Figure 6:
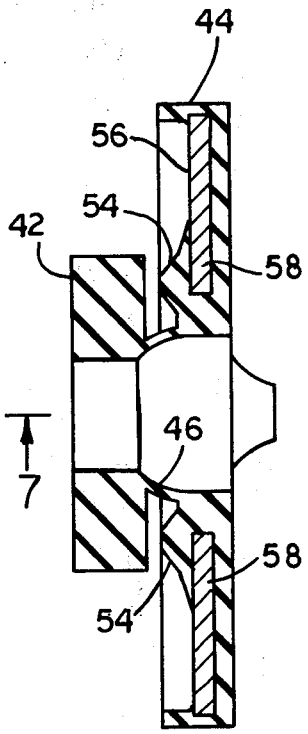
FIG. 6 is a cross-section taken along lines 6—6 of FIG. 5.
Figure 7:
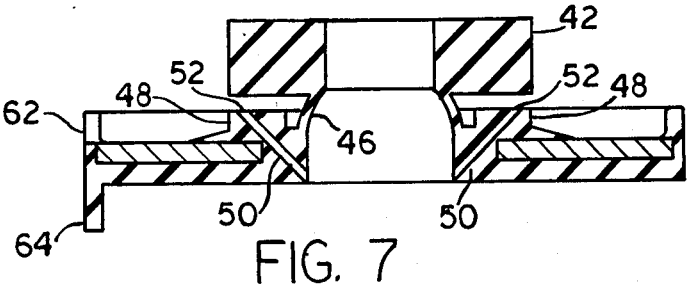
FIG. 7 is a cross-section taken along lines 7—7 of FIG. 5.

The attachment 40 also has an annular container closure member 44, having a central opening spaced from the sleeve **30*a*. The annular member 44 is connected to the upper annular member 42 by means of a tubular member 46 which bows outwardly, as shown more particularly in FIGS. 6 and 7. The tubular member 46 is flexible and resilient and tends to hold the two annular members apart, as shown in FIGS. 4, 6, and 7, but which collapses under pressure to the position shown in FIG. 3**.

On the upper surface of the closure member 44 are raised portions or protuberances 48, preferably arranged on opposite sides. The tops of the raised portions 48 are flat and are adapted to be covered by the annular member 42 in surface-to-surface contact when the container closure member 44 is pushed upwardly and the tubular member 46 is collapsed.

A vent aperture 50 extends from a vent end opening 52 in the raised portions 48 to the inner surface of the central bore of the closure member 44. The raised portions 48 have flat upper surfaces adapted to lie in surface-to-surface contact with complementary portions of the upper annulus 42.

There may also be provided additional protuberances 54, conical in shape, if desired, which are at an altitude the same as or slightly lower than the height of the raised portions 48. The raised portions 54, coupled with the raised portions 48, form pressure points, whereby pressure on annular member 42 is applied to the closure member 44, and vice versa. The integral attachment is a unitary casting of elastomeric material of sufficient rigidity to retain its shape under the normal handling and operation of the device. If desired, there may be cast into the attachment 40 an annular inlay 56 of stainless steel or like rigid material. Advantageously, the inner edge 58 extends inwardly under the pressure points 48 and 54, so that the pressure is more evenly distributed from the annulus 42 to the annular closure member 44.

The annular closure member 44 has an upstanding lip 60 to catch any drippings from the device. The lip 60 has a gate 62 and a drip guide 64 for handling these drippings.

In a preferred form of the device, the diaphragm 22 and the tubular member 46 are constructed so that the tubular member 46 collapses first. Thus, when the container is pushed upward in contact with the closure member 44, the tubular member 46 collapses and the raised portions 48 are brought into surface-to-surface contact with the annulus member 42 so that the vent openings 52 are effectively sealed off. Then, further movement of the container upward causes the diaphragm 22 to collapse, as shown in FIG. 3. This causes an upward movement of the annular member 42 and a corresponding upward movement of the sleeve 30*a*, which is unitary therein. Thus, the sleeve is raised to the position shown in FIG. 3, wherein the liquid discharge portion 28*a* is opened, allowing liquid to flow from the reservoir into the container and the vent 26*a* is opened allowing air from the container to flow out through the vent to the ambient atmosphere. In this position, since the vent end openings 52 are closed, the only access to the container is through either the liquid discharge portion 28*a* or the vent 26*a*. When the liquid level in the container reaches the bottom of the sleeve 30*a*, no more liquid will accumulate in the container and the liquid will flow up vent 26*a* until an equilibrium is obtained. At this stage, the container is lowered and expansion of the cup-shaped diaphragm 22 forces the assembly down until the sleeve 30 seats an O ring 32 and seals off the vent 26*a* and the liquid discharge 28*a*. On further lowering of the container, the vent end openings 52 are uncovered and equilibrium is established between the ambient atmosphere and the head space of the container.

Advantageously, the surface area of the raised portions 48 is kept small enough so that any vacuum which obtains in the head space can be easily broken. Advantageously, the surface area of the raised portions 48 is not greater than $\frac{1}{2}$ square inch, so that a pressure not substantially greater than about 7.5 pounds is all that is required to break the vacuum. Preferably, the area is substantially less than that. If, for example, the diameter of the raised portions 48 is $\frac{1}{2}$ inch, the area, $A=\pi r^2$, will be equal to 0.2 square inch. Two times this (where there are two raised portions 48) makes a total area of 0.4 square inch. Multiplying atmospheric pressure of 14.7 pounds per square inch times 0.4 square inch equals about 5.88 pounds, maximum pressure required to break the vacuum in the head space of the container. Thus, by constructing the tubular member 46 of a thinness or thickness to exert about 7 pounds of resilience, when the diaphragm 22 is constructed to exert about 10 pounds per square inch of resilience, the vent end openings 52 will always be closed while the primary vent 26*a* is open and will not open until the liquid discharge 28*a* and the primary vent 26*a* have been closed.

In another form of the invention, the relative forces necessary to collapse the diaphragm 22 and the tubular member 46 are such that the diaphragm 22 collapses first. In operation, then, the container is initially pushed up until the sleeve valve 30*a* opens but the vent end openings 52 are not yet closed. Thus, during filling, this head space is vented through both the primary and secondary vents. Then before the liquid level reaches the bottom of the sleeve valve 30*a*, the container is pushed up to seal off the vent end opening 52, so that the liquid does not rise in the container to a level above the bottom of the sleeve valve 30*a*. When it reaches the level, the container is rapidly lowered, causing the sleeve valve 30*a* to seal against O ring 32 before any appreciable rise in the liquid level can take place, because of the fact that the vent end openings 52 are uncovered first.

A washer or washers 66 may be added between the attachment 40 and the closure member 16 in order to adjust the depth to which the sleeve 30*a* extends into the container.

If desired, the closure member 16 can be omitted. In such case, the collar 38 will rest directly on the annular member 42, or on the washer 66.

It is to be understood that the invention is not to be limited to the exact details of operation or structure shown and described, as obvious modifications and equivalents will be apparent to one skilled in the art.

I claim:

1. In a container filling device which comprises (a) a container closure member;

(b) a filling head projecting downwardly axially through said closure member and having a liquid discharge means for discharging liquid into said container and primary vent means for venting gas from the head space of said container as it is being filled;

(c) first closure means for closing said filling head and simultaneously closing both said liquid discharge means and said primary vent means;

(d) first resilient means for urging said first closure means to a closed position;

(e) first coupling means between said first closure means and said container closure member operative on upward movement of the latter to compress said first resilient means and to open said first closure means;

(f) secondary vent means for venting said head space when said first closure means is in closed position;

(g) second vent means for closing said secondary vent means;

(h) second resilient means for urging said second vent closure means to open position;

(i) second coupling means for coupling said container closure member and said second vent closure means operative on movement of said container closure member upward to compress said second resilient means and to close said secondary vent means;

(j) said container closure member being an annulus having a sealing surface on its under surface which is adapted to engage the mouth of the container during the filling operation, so that the only access to the interior of said container is through said liquid discharge means and said vent means; the combination in which, (1) said secondary vent means comprises at least one aperture having its vent end opening in the portion of the upper surface of said container closure member which is exposed to the ambient atmosphere and lies between the central opening and the periphery of the annulus thereof and its inner end opening in a surface of said annular member which is exposed to the atmosphere confined in the head space of the container;

(2) said second vent closure means comprises a second annular member surrounding said filling head and spaced above said first annular member and held away therefrom by said second resilient means except when the latter is compressed;

(3) and said annular members have an island of surface-to-surface contact surrounding each said vent end opening.

2. A container filling device of claim 1, in which said first resilient means requires more force to compress it than that required to compress said second resilient means whereby, upon upward movement of said closure member, said secondary vent means is closed before said first closure means and, in the reverse direction, said first closure means is closed before said secondary vent means is opened.

3. A container filling device of claim 1, in which the total area of said surface-to-surface contact between said annular members is not greater than about one-half square inch and the pressure engendered by said second resilient means when it is compressed is greater than the said area times 14.7, but not substantially greater than about 7.5.

4. A container filling device of claim 2, in which the pressure required to compress both said resilient means does not exceed about ten pounds.

5. A container filling device of claim 1, in which said annular closure member has a plurality of raised portions on the upper surface thereof, at least one of which surrounds a vent end opening of said vent means and in which said second annular member has a complementary surface adapted to lie in surface-to-surface contact therewith.

6. A container filling device of claim 5, in which each raised portion which has a vent end opening therein has a flat upper surface and the portion of the upper annulus apposed thereto has a complementary flat surface.

7. A container filling device of claim 6, in which several raised portions are symmetrically arranged on the surface of said annular closure member.

8. A container filling device of claim 7, in which two raised portions 180° apart have vent end openings therein and two other raised portions spaced 180° apart and 90° from the first two do not.

9. A container filling device of claim 2, in which said first closure means comprises a tubular sleeve telescoped on said filling head and adapted to close said filling head, said sleeve being secured to said first resilient means and to said second annular member whereby, when the container engages said annular closure member and pushes it up, said first resilient member is compressed and said sleeve is lifted from its closed position to open said first vent means and said liquid discharge means and, on further upward movement of said container, said second resilient means is compressed and said second vent means is closed.

10. A container filling device of claim 9, in which said second resilient means comprises an integral tubular member connecting the upper and lower annular members and in which the upper annular member fits snugly about said sleeve so that it moves as a unit therewith, and in which said lower annular member is spaced from said sleeve so that it can move freely toward and away from said upper annular member.

11. A container filling device of claim 10, in which the inner end of each said secondary vent aperture opens into the space between said annular closure member and said sleeve.

12. An integral attachment for a container filling device, in which a filling head has a tubular closure adapted to be opened when the filling head is inserted into the container to be filled, which attachment comprises an annular member functioning as a container closure member and having a central opening slightly larger than said tubular closure, an upper annular member spaced from said first annular member and integrally connected thereto by a resilient tubular member, said upper annular member having a close fit with said tubular closure in order to hold said attachment in place when it is slid onto said tubular closure, more than one vent aperture extending through said lower annular member with its vent end opening in the upper surface thereof in a position where it is adapted to be closed by said upper annular member when said resilient tubular member is collapsed by pushing the lower annular member upward into contact with the upper annular member, and said annular members having an island of surface-to-surface contact surrounding each said vent end opening.

13. An integral attachment according to claim 12, in which the upper surface of said annular member has at least two raised portions and in which a vent end opening opens in the surface of at least one of said raised portions.

14. An integral attachment according to claim 12, in which each said island of surface-to-surface contact comprises a raised portion on the upper surface of said annular closure member.

15. An integral attachment according to claim 14, in which there are other raised portions which do not have vent end openings in the surface thereof, said raised portions providing pressure points between said annular members to effect an even distribution of pressure from said upper annular member to said annular closure member.

16. An integral attachment for a container filling device according to claim 12, in which said resilient tubular portion bulges in the middle, so that collapse thereof is facilitated when the lower annular member is moved toward the upper annular member.

17. An integral attachment for a container filling device according to claim 13, in which said vent apertures extend from said raised portions to the wall of the central opening of said annular closure member.

18. An integral attachment for a container filling device according to claim 15, in which the lower annular member has a reinforcing annular inlay extending outwardly from under said pressure points.

19. A container closure filling device comprising an annular container closure member composed of elastomeric material and having a plurality of pressure points on the upper surface thereof and a reinforcing annular inlay, the inner portion of which underlies said pressure points.

* * * * *

UNITED STATES PATENT AND TRADEMARK OFFICE

CERTIFICATE OF CORRECTION

PATENT NO. : 4,269,236

DATED : May 26, 1981

INVENTOR(S) : Michael T. Fogg

It is certified that error appears in the above—identified patent and that said Letters Patent is hereby corrected as shown below:

[56] References Cited, U.S. PATENT DOCUMENTS, line 2; "3,729,030 3/1973" should read -- 3,729,030 4/1973 -- (copy of original document)
Col. 2, line 8; "vents," should read -- events, --
Col. 2, line 59; "undersurface;" should read -- undersurface, --
Col. 4, line 20; delete "most" (first occurrence)
Col. 4, line 38; "aperatures" should read -- apertures --
Col. 7, line 59; "the" (third occurrence) should read -- this --
Col. 8, line 68; "means and," should read -- means opens and, --

Signed and Sealed this

*Sixth* Day of *October 1981*

[SEAL]

*Attest:*

GERALD J. MOSSINGHOFF

*Attesting Officer* *Commissioner of Patents and Trademarks*